US009327805B2

(12) United States Patent
Wang et al.

(10) Patent No.: US 9,327,805 B2
(45) Date of Patent: May 3, 2016

(54) VERTICAL OIL STORAGE SYSTEM AND ITS METHOD FOR DEEPWATER DRILLING AND PRODUCTION

(71) Applicants: Jin Wang, Houston, TX (US); Yong Luo, Houston, TX (US)

(72) Inventors: Jin Wang, Houston, TX (US); Yong Luo, Houston, TX (US)

(73) Assignees: China National Offshore Oil Corporation, Beijing (CN); COTEC, Inc., Houston, TX (US)

( * ) Notice: Subject to any disclaimer, the term of this patent is extended or adjusted under 35 U.S.C. 154(b) by 0 days.

(21) Appl. No.: 13/960,724

(22) Filed: Aug. 6, 2013

(65) Prior Publication Data

US 2015/0041142 A1 Feb. 12, 2015

Related U.S. Application Data

(60) Provisional application No. 61/680,665, filed on Aug. 7, 2012.

(51) Int. Cl.
*E21B 41/00* (2006.01)
*B63B 35/44* (2006.01)

(52) U.S. Cl.
CPC ..... *B63B 35/44* (2013.01); *B63B 35/4413* (2013.01)

(58) Field of Classification Search
CPC .... E21B 41/0007; B65D 88/78; B63B 35/44; B63B 35/4413; B63B 2035/442
USPC ..... 166/335, 352, 358; 114/264, 256, 257; 405/195.1, 210
See application file for complete search history.

(56) References Cited

U.S. PATENT DOCUMENTS

| | | | | | |
|---|---|---|---|---|---|
| 3,322,087 | A * | 5/1967 | Tucker | 114/256 |
| 3,360,810 | A * | 1/1968 | Busking | 441/5 |
| 3,429,128 | A * | 2/1969 | Chamberlin et al. | 405/210 |
| 3,667,240 | A * | 6/1972 | Vilain | 405/202 |
| 3,880,102 | A * | 4/1975 | Biewer | 114/256 |
| 3,961,488 | A * | 6/1976 | Ovsttun | 405/210 |
| 4,059,065 | A * | 11/1977 | Clark et al. | 114/256 |
| 4,209,271 | A * | 6/1980 | McCabe et al. | 405/210 |
| 4,606,673 | A * | 8/1986 | Daniell | 405/210 |
| 4,702,321 | A * | 10/1987 | Horton | 166/350 |
| 5,706,897 | A * | 1/1998 | Horton, III | 166/359 |
| 5,722,797 | A * | 3/1998 | Horton, III | 405/224 |
| 8,011,312 | B2 * | 9/2011 | Finn et al. | 114/256 |
| 2002/0040904 | A1 * | 4/2002 | Lee | 220/560 |
| 2005/0163572 | A1 * | 7/2005 | Keron | 405/210 |

* cited by examiner

*Primary Examiner* — Matthew R Buck
(74) *Attorney, Agent, or Firm* — Lai, Corsini & Lapus, LLC; Theodore Lapus

(57) ABSTRACT

A vertical oil storage system is disclosed, having an oil tank for storing oil and water, an oil caisson coupled to the top of the oil tank, a water caisson coupled to the bottom of the oil tank, and a containment saucer at the interface between the oil and the water stored in the oil tank. Additionally, there is a water pipe extending from an upper water sump in the center well to the water caisson, a water passageway extending from the center well to the water caisson, and an oil pipe extending from the topside facility to the oil caisson.

10 Claims, 9 Drawing Sheets

VERTICAL OIL STORAGE SYSTEM AND ITS METHOD FOR DEEPWATER DRILLING AND PRODUCTION

FIELD OF THE INVENTION

The present invention a s generally to the field of an offshore oil storage system and its method for use with offshore oil drilling and production facilities. More particularly, the invention relates to a vertical oil storage system and its water-displacement and oil-water separation method to displace water with oil or displace oil with water without discharging oil-contaminated water into open seawater directly.

BACKGROUND OF THE INVENTION

FIGS. 1 and 2A disclose a front view and a perspective view of a traditional floating SPAR platform 100 for offshore oil drilling and production. In FIG. 2A, the SPAR platform 100 includes a topside facility 202 for oil drilling and production and a draft hull 204. The topside facility 202 is located above a waterline 200. The draft hull 204 is located below the topside facility 202 and is normally 650 to 750 feet long, with a 90 to 160 feet diameter, and mostly submerged in the seawater. The draft hull 204 usually has an in-service draft in the order of 600 to 700 feet depending on metocean conditions of the area where the SPAR platform 100 is deployed.

The draft hull 204 can include three main components: a hard tank 206 located in the upper part of the draft hull 204 for providing buoyancy to support the topside facility 202, a mid tank 208 located below the hard tank 206 for oil storage or completely being flooded with seawater, and a soft tank 210 located at the bottom of the SPAR platform 100 for providing ballast for platform stability. The hard tank 206 includes a water ballast tank 214 at its lower end and a center well 212 located in the center of the hard tank 206. The center well 212 can be filled with water from top to bottom and directly connected with open seawater at the keel of the SPAR platform 100 via a water passageway 218 (or a riser guide tube), which is watertight and extends through the mid tank 208. A watertight deck 220 can be applied at the top (in the center well 212 of the hard tank 206) and the end (at the bottom of the soft tank 210) of the water passageway 218. FIG. 2B is a top view of the watertight deck 220 located at the top of the water passageway 218 in the hard tank 206. The watertight deck 220 can contain multiple watertight deck openings 222 for the water passageway 218 to pass through. Also, a set of mooring lines 216 can be applied to the exterior of the SPAR platform 100 to secure the position of the floating SPAR platform 100 to the seabed (not shown) in the seawater.

In a traditional SPAR platform, such as the SPAR platform 100 shown in FIGS. 1 and 2A, a wet storage system may be applied. The definition of the wet storage is that the oil is stored by displacing the water in the same tank or compartment and an oil-water interface is created in between. The advantage of the wet storage method is that the external water pressure and internal water pressure of the storage tank are substantially balanced so that the shell structure of the oil storage tank can be designed more economically for deep draft vertical oil storage applications. The disadvantage is that the wet storage could cause environmental pollution if the displaced oil-contaminated water is discharged into the open seawater directly without proper treatment. It is conventionally considered difficult to separate a large quantity of oil from water completely without costly specialized equipment which would add significant weight to the platform's topside facilities. To solve the pollution problem and comply with applicable environmental laws, the conventional way to export the produced oil from a SPAR platform is via a deepwater pipeline, instead of storing the oil within the platform and exporting the oil via a shuttle tank. However, the deepwater pipeline is generally very costly to construct because deepwater offshore oil fields are usually very far from shore.

As described above, a need exists for an improved oil storage system to be applied with an offshore oil drilling and production platform.

A further need exists for an improved oil storage system with an improved water displacement method to separate oil from water before water being discharged into open seawater to avoid environmental pollution.

The present embodiments of the system and the method meet these needs and improve on the technology.

BRIEF DESCRIPTION OF THE DRAWINGS

The drawings described herein are for illustrating purposes only of selected embodiments and not all possible implementation and are not intended to limit the scope of the present disclosure.

The detailed description will be better understood in conjunction with the accompanying drawings as follows.

The present embodiments are detailed below with reference to the listed Figures.

DETAILED DESCRIPTION OF THE EMBODIMENTS

Before explaining the present invention in detail, it is to be understood that the present invention is not limited to the particular embodiments and that it can be practiced or carried in various ways.

It is understood that the vertical oil storage system and its method can be used in any body of water. The term "oil" can comprise crude oil and other hydrocarbon oils. The term "water" can comprise seawater and fresh water.

The invention relates to a vertical oil storage system and its water-displacement and oil-water separation method to displace oil with water or displace water with oil without discharging oil-contaminated water into open water directly.

Figure 1:
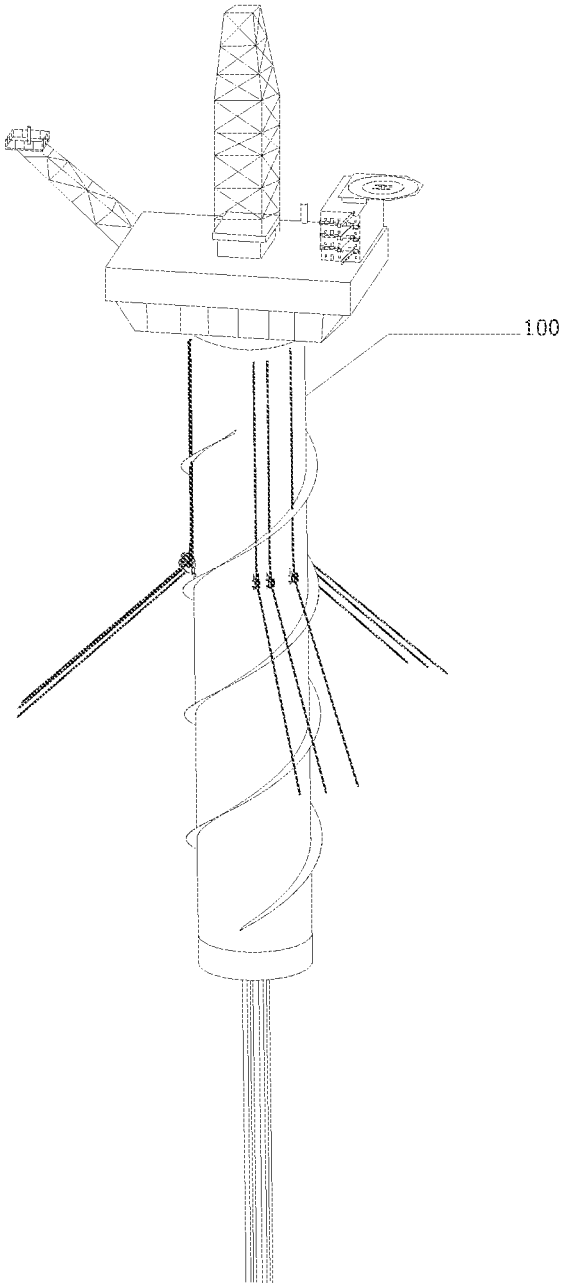
FIG. 1 illustrates a front view of a prior art of a conventional floating SPAR platform for oil drilling and production without oil storage where a mid tank is completely flooded with seawater.
Figure 2A:
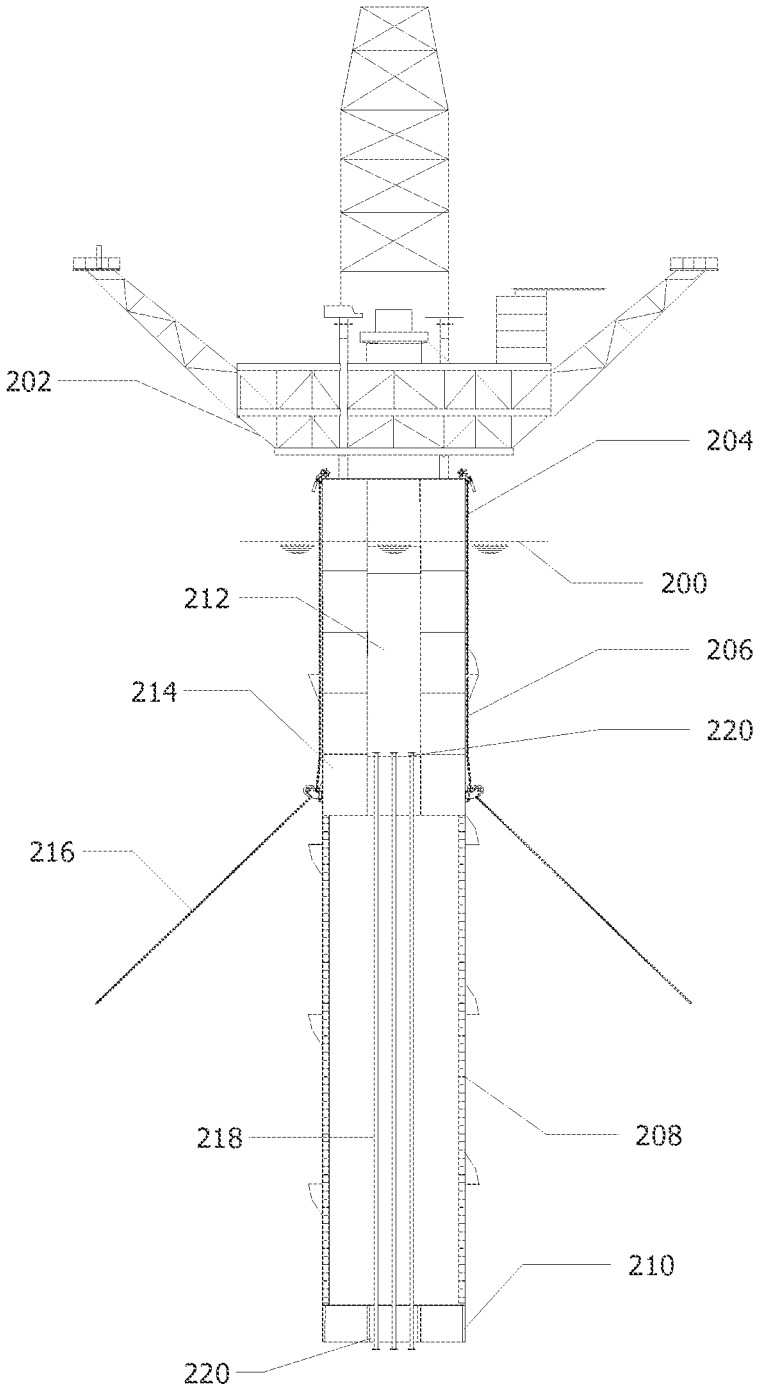
FIG. 2A illustrates a perspective view of the in-board profile of an improved application of the conventional SPAR platform for oil drilling, production, and oil storage where a mid tank is used for oil storage.
Figure 2B:
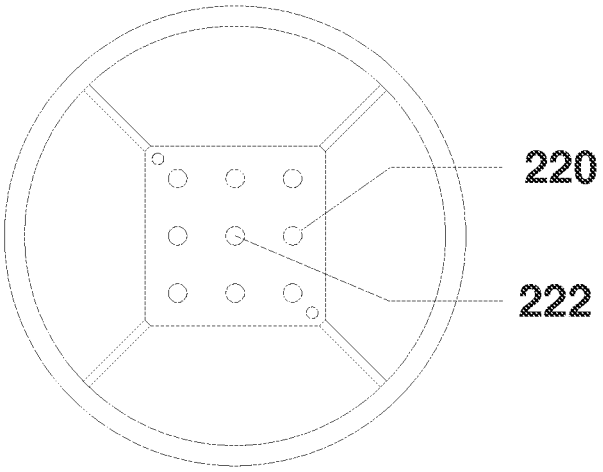
FIG. 2B illustrates a top view of a watertight deck in a hard tank.
Figure 3A:
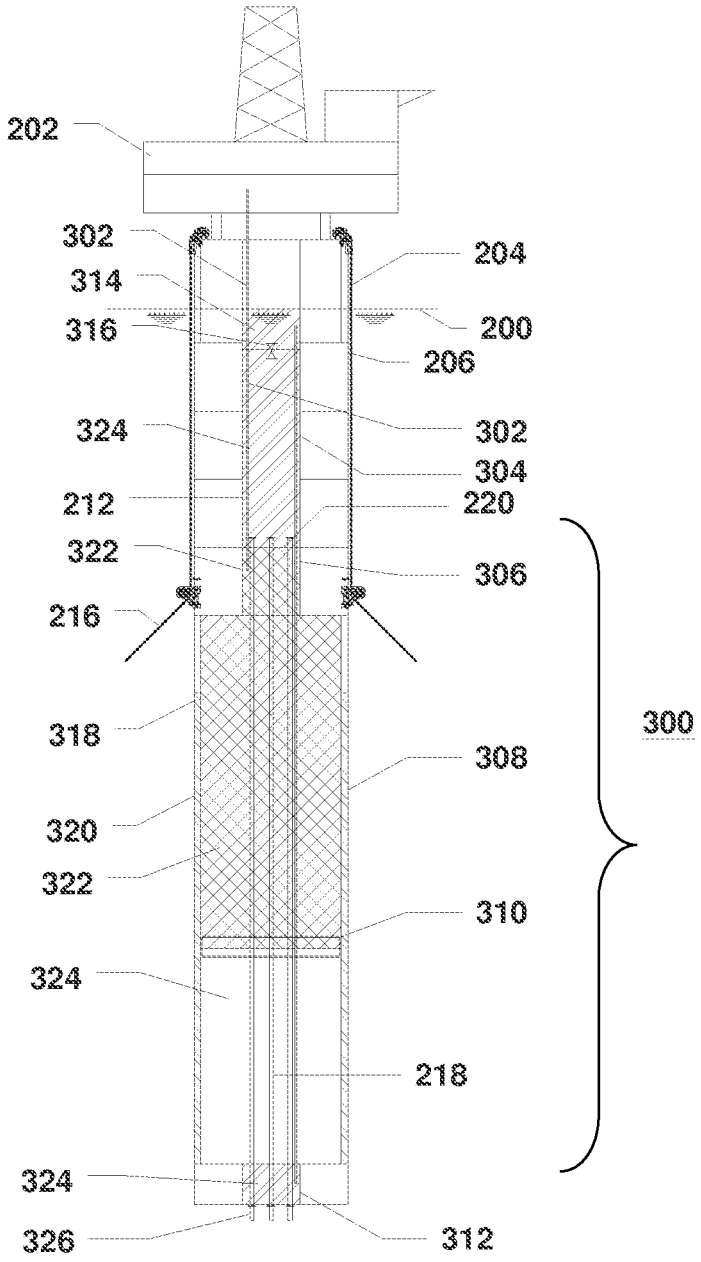
FIG. 3A illustrate a perspective view of a vertical oil storage system according to some embodiments of the present invention.

FIG. 3A discloses a perspective view of a vertical oil storage system 300 formed in a SPAR floating platform according to some embodiments of the present invention. The vertical oil storage system 300 can include an oil tank 308 for storing oil 322 and water 324, an oil caisson 306 coupled to the top of the oil tank 308 for storing oil 322, a water caisson 312 coupled to the bottom of the oil tank 308 for storing water 324, a containment saucer 310 positioned substantially at the interface between the stored oil 322 and the stored water 324, a water pipe 304 extending from an upper water sump 314 in the center well 212 to the water caisson 312, a water passageway 218 extending from the center well 212 to the water caisson 312, and an oil pipe 302 extending from the topside facility 202 to the oil caisson 306.

The containment saucer 310 can be for containing the oil-water interface and separating the oil 322 from the water 324. Also, to further ensure the water 324 will not be contaminated by the oil 322 when it is discharged back to open water, when the produced oil 322 is loaded into the vertical oil storage system 300, corresponding amount of water 324, which is supposed to be offloaded out of the vertical oil storage system 300 into ambient water to keep platform stability, can be offloaded from the oil tank 308 to the upper water sump 314 in the center well 212 via the water pipe 304 first, instead of being discharged hack to open water via a water outlet 326 at the keel of the platform directly. in the upper water sump 314, even when the water 324, which is just loaded into the upper water sump 314 from the water caisson 312, still contains few amount of oil 322, the oil 322 would float above the water 324 in the upper water sump 314. Finally, the pure water 324, which has been gone through the oil-water separation process twice in the oil tank 308 and in the upper water sump 314, can be offloaded from the bottom of the center well 212 back to open water at the water outlet 326 at the keel of the platform via the water passageway 218. The long distance between the keel of the platform and the upper water sump 314 (typically more than 600 feet) can further enhance the oil-water separation process by gravity and guarantees that no oil will be discharged to the open water.

Figure 3B:
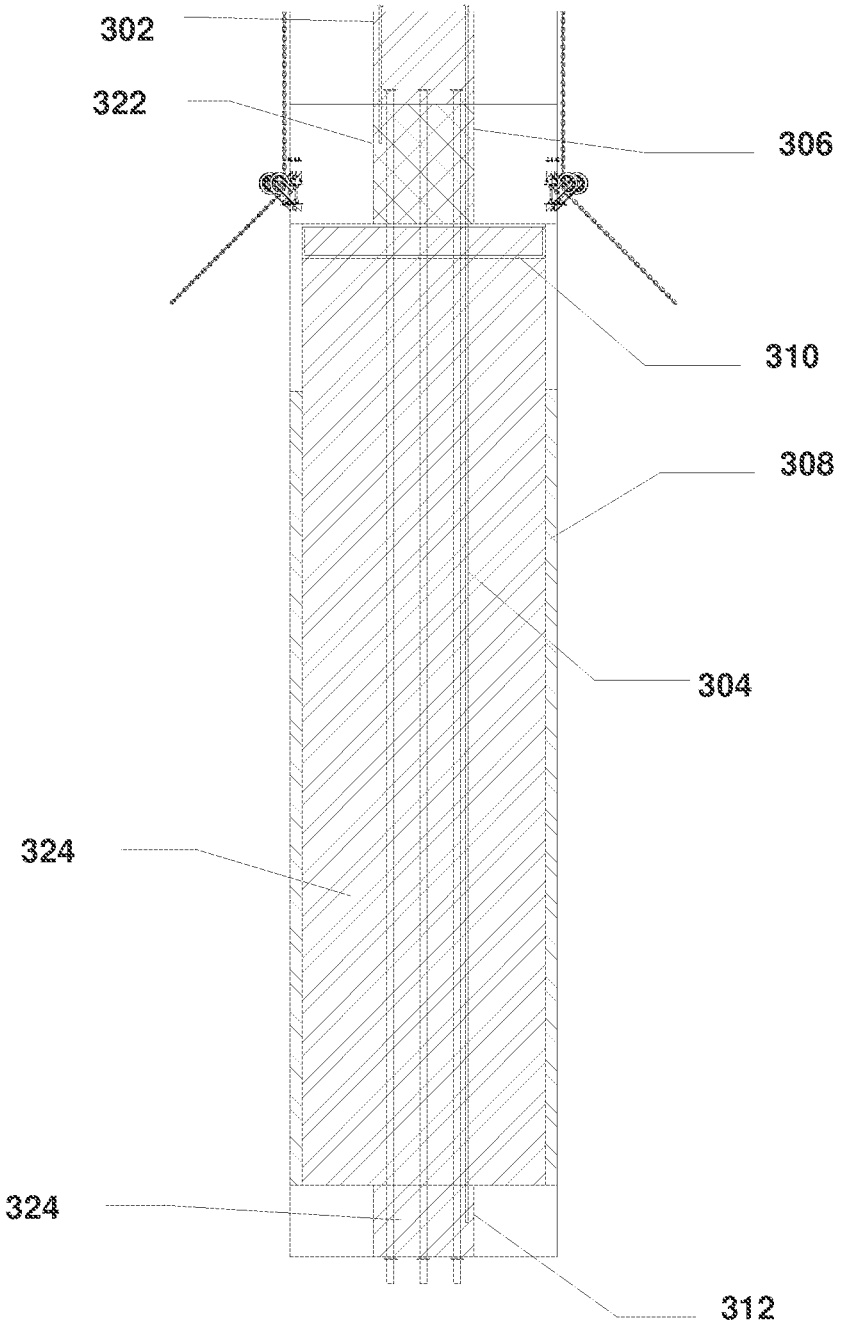
FIG. 3B illustrates a first boundary condition of an oil tank.
Figure 3C:
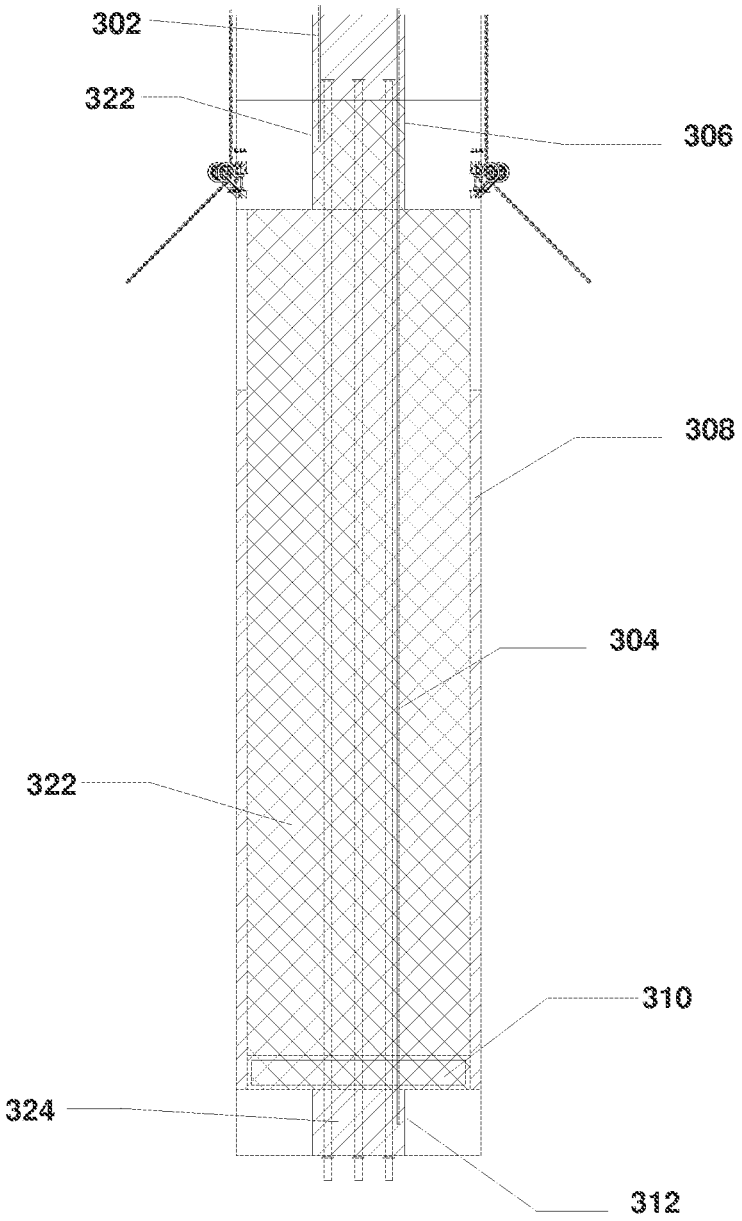
FIG. 3C illustrates a second boundary condition of the oil tank.

The oil caisson 306 can store substantially pure oil 322, even when the containment saucer 310 is located at the top of the oil tank 308 under the $1^{st}$ boundary condition shown in FIG. 3B. The water caisson 312 can store substantially pure water 324, even when the containment saucer 310 is located at the bottom of the oil tank 308 under the $2^{nd}$ boundary condition shown in FIG. 3C. There are three main reasons why the oil caisson 306/the water caisson 312 can store substantially pure oil/water: 1) the density of oil (~0.8~0.9) is always less than the density of water (i.e. the density of seawater is around 1.025) and therefore oil would naturally float above water; 2) the containment saucer 310 with an equivalent density between the densities of oil and the water is located in between the oil 322 and the water 324 for separating them from each other; and 3) the cross-areas of the oil caisson 306 and the water caisson 312 are less than it of the oil tank 308 and therefore the containment saucer 310 can confine the water 324 within the oil tank 308 even under the $1^{st}$ boundary condition as shown in FIG. 3B and confine the oil 322 within the oil tank 308 even under the 2nd boundary condition as shown in FIG. 3C.

In some embodiments, a deck valve 316 can be applied at the bottom of the upper water sump 314 for separating the area of the upper water sump 314 from the center well 212. When the cleanness procedure of the upper water sump 314 is deemed necessary, the deck valve 316 can be closed to isolate the area of the upper water sump 314. Furthermore, it is easier to clean only the upper water sump 314 instead of the entire center well 212, because the upper water sump 314 is close to the waterline 200 and easy to be accessed to.

In some embodiments, the oil tank 308 can have a cofferdam 320 for a structural safety purpose. The cofferdam 320 preferably has a double hull structure. The space inside the cofferdam 320 can be filled with water and compressed air 318 for keeping the draft hull 204 at a constant level when the oil tank 308 is loading or offloading oil or water. Adjustment of the amount of water inside the cofferdam 320 can be achieved by pumping in/out water via a water pump (not shown in the FIG. 3A) directly or pumping in/out the compressed air 318 via an air pump (not shown in the FIG. 3A) to let water flow out of/into the cofferdam 320. An opening for water passage is preferably at the bottom of the cofferdam 320.

Figure 4A:
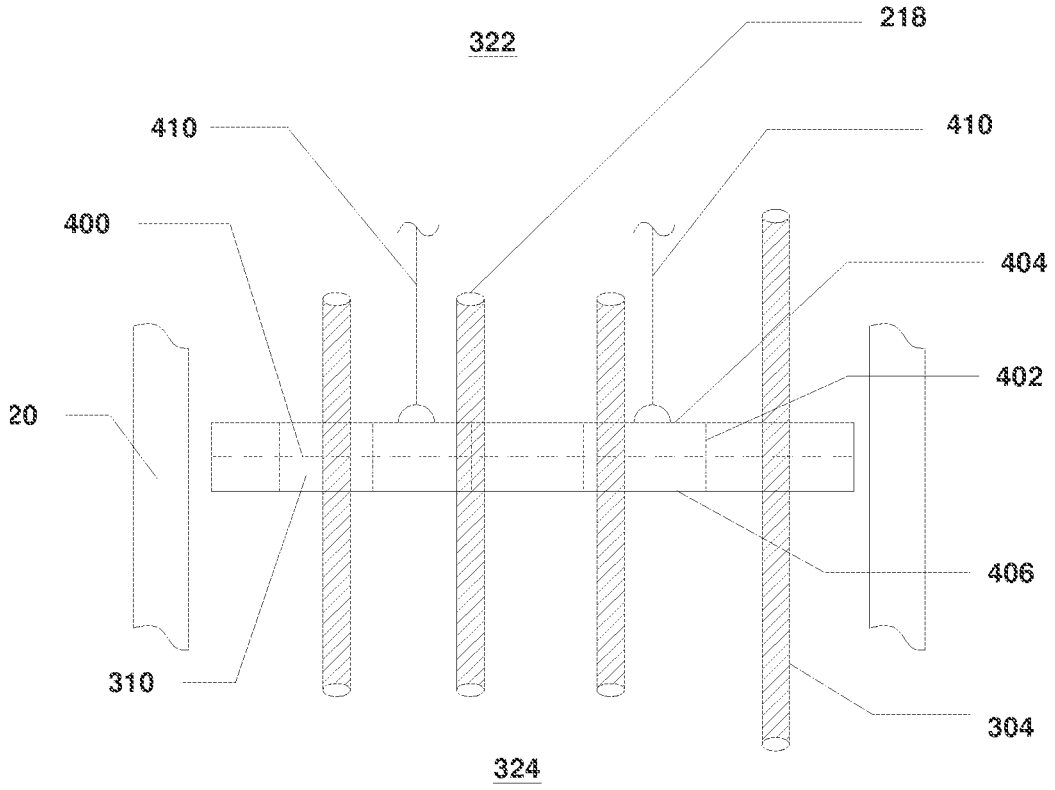
FIG. 4A illustrates a perspective view of a containment saucer according to some embodiments of the present invention.
Figure 4B:
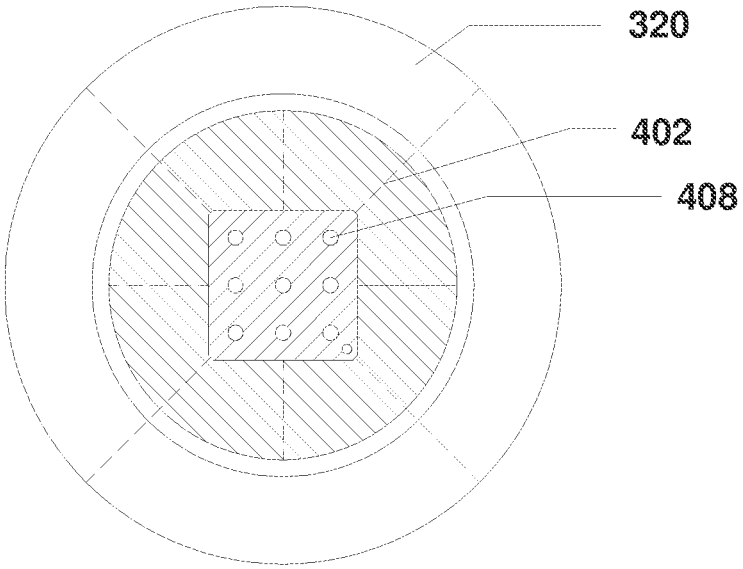
FIG. 4B illustrates a top view of the containment saucer.

FIGS. 4A and 4B discloses a perspective view and a top view of the containment saucer 310 in the oil tank 308. The diameter of the containment saucer 310 can be substantially equal to the inner diameter of the oil tank 308. The depth of the containment saucer 310 can be around 6~20 feet depending on the diameter of the draft hull 204. The containment saucer 310 can be made of rubber, synthetic fiber, any material or their combination, which has an overall equivalent density between the densities of the oil 322 and the water 324. Preferably, the density of the containment saucer 310 is around the average density of the densities of the oil 322 and the water 324 to keep an oil-water interface 400 at the middle of the containment saucer 310.

The containment saucer 310 can include an upper deck 404, a lower deck 406, and one or multiple baffle plates 402 located between the upper deck 404 and the lower deck 406. The upper deck 404 and the lower deck 406 can further include one or multiple saucer deck openings 408 for the water passageway 218 and the water pipe 304 to go through and to ensure that fluid communication in a vertical direction is not blocked by the containment saucer 310. In that way, the containment saucer 310 can float up and down smoothly with the movement of the oil-water interface 400. Based on the fact that the density of the containment saucer 310 is between the densities of the oil 322 and the water 324, the oil-water interface 400 can be well confined within the depth of the containment saucer 310. Therefore, the oil 322 above the containment saucer 310 and the water 324 below the containment saucer 310 can be adequately separated from each other. The baffles plates 402 can further reduce the free surface effect of the oil-water interface 400 and help minimize a mixture of the oil 322 and the water 324.

In some embodiments, the baffle plates 402 can also have one or multiple holes (not shown in FIG. 4A) to allow fluid communication in a horizontal direction.

Figure 5:
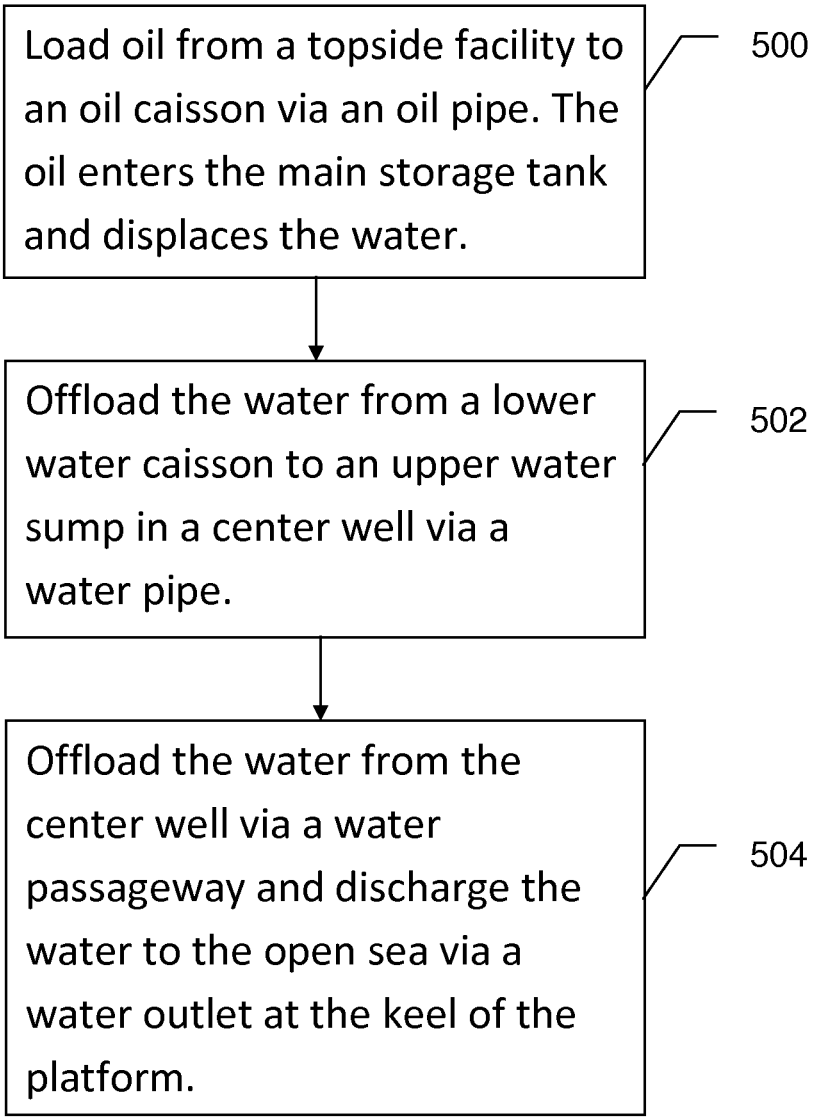
FIG. 5 illustrates a flow chart of a water-displacement and oil-water separation method according to some embodiments of the present invention.

FIG. 5 discloses a corresponding method to displace water with oil and to separate oil from displaced water in the vertical oil storage system 300. The method includes loading oil from a topside facility into an oil caisson via an oil pipe 500, offloading water from a water caisson into an upper water sump in a center well via a water pipe 502, offloading water from the center well via a water passageway and discharging it back to open water via a water outlet at the keel of the platform 504.

In some embodiments, loading oil from the topside facility into the oil caisson via an oil pipe 500 further includes the step of utilizing an oil pump to pump oil from the topside facility into the oil caisson.

In some embodiments, offloading water from the water caisson into the upper water sump via the water pipe 502 further includes the step of utilizing a water pump to pump the water from the water caisson into the upper water sump.

The present invention is in no way limited to being applied to an particular platform or body of water.

The present invention is in no way limited to being applied to any particular number of oil tanks, internal water pipes, internal oil pipes, water passageways, or containment saucers.

In conclusion, exemplary embodiments of the present invention stated above may provide several advantages as follows. The present invention utilizes an arrangement of a containment saucer, caissons, water and oil pipes, and a water passageway to separate oil from water before it being discharged into open water to prevent environmental pollution. Furthermore, the present invention makes it possible to apply the wet storage method to a conventional SPAR platform or any other platforms to store produced oil in order to save the cost for building expensive deepwater pipelines for oil export.

What is claimed is:

1. A deepwater oil drilling, production and storage system comprising:

a topside facility for offshore oil drilling and production;

a deep draft hull with a vertical tank for storing oil and water, said deep draft hull further comprising, an upper tank, with a bottom water ballast tank and a center well centrally located inside the upper tank therein;

a middle reservoir tank;

a bottom tank;

a watertight water channel within said middle reservoir tank extending upward into said center well of said upper tank and downward below the bottom of said bottom tank;

an oil caisson connectively attached to the top of said reservoir tank;

a water caisson connectively attached to the bottom of said reservoir tank;

a water pipe extending upwards into an upper sump located in said center well centrally located inside said upper tank, and connectively extending downward into said water caisson;

a water passageway comprised of a plurality of said watertight water channels extending from said center well centrally located inside said upper tank connectively extending downward through said middle reservoir tank to external water below said bottom tank, and;

an oil pipe extending from said oil caisson into said topside facility.

2. The deepwater oil drilling, production and storage system according to claim 1 wherein the vertical tank includes a containment saucer with a diameter substantially equal to the interior diameter of the reservoir tank, said containment saucer with an overall density between the density of the oil and the density of the water within the vertical tank.

3. The deepwater oil drilling, production and system according to claim 1 wherein a deck valve is disposed at the bottom of said upper sump.

4. The deepwater oil drilling, production and storage system according to claim 1 wherein said reservoir tank is enclosed within a double-walled cofferdam structure having, an open channel at the bottom of the double-walled cofferdam structure, a water pump disposed to inject water into the double-walled cofferdam structure, and an air pump disposed to inject compressed air into the double-walled cofferdam structure.

5. The deepwater oil drilling, production and storage system according to claim 2 wherein said containment saucer comprises, an upper deck, with multiple deck openings to permit said water pipe and said water pipeline to pass through, and to further permit fluid communication in a vertical direction;

a lower deck, with multiple deck openings to permit said water pipe and said water pipeline to pass through, and to further permit fluid communication in a vertical direction; and, multiple baffle plates disposed between the upper deck and lower deck.

6. The deepwater oil drilling, production and storage system according to claim 5 wherein said multiple baffle plates have one or more holes to permit fluid communication in a horizontal direction.

7. A deepwater vertical storage apparatus comprising, a vertical tank having a double-walled cofferdam structure for storing oil and water;

an upper caisson coupled to the top of said vertical tank for storing oil; and a lower caisson coupled to the bottom of said vertical tank for storing water;

a center well located centrally on top of said upper caisson, with an upper sump disposed in the upper portion of the center well;

a water pipe extending upwards into said upper sump, and connectively extending downward into said lower caisson;

a water passageway extending from said center well connectively extending downward through said vertical tank to external water below said lower caisson;

an oil pipe extending from said upper caisson into a topside facility; and, a watertight water channel within said vertical tank extending upward to the top of said upper caisson and downward to the bottom of said lower caisson.

8. The deepwater vertical storage apparatus of claim 7 further comprising a containment saucer positioned substantially at the interface between the stored liquids.

9. The deepwater vertical storage apparatus of claim 8 wherein said containment saucer further comprises, an upper deck, with multiple deck openings to permit said water pipe and said water pipeline to pass through, and to further permit fluid communication in a vertical direction;

a lower deck, with multiple deck openings to permit said water pipe and said water pipeline to pass through, and to further permit fluid communication in a vertical direction; and, multiple baffle plates disposed between the upper deck and lower deck.

10. The deepwater vertical storage apparatus of claim 9 wherein said multiple baffle plates have one or more holes to permit fluid communication in a horizontal direction.

* * * * *

UNITED STATES PATENT AND TRADEMARK OFFICE

CERTIFICATE OF CORRECTION

PATENT NO. : 9,327,805 B2
APPLICATION NO. : 13/960724
DATED : May 3, 2016
INVENTOR(S) : Wang et al.

It is certified that error appears in the above-identified patent and that said Letters Patent is hereby corrected as shown below:

Title Page, Item (72) Inventor is corrected to read:
-- Jin Wang, Houston (TX);
Yong Luo, Houston (TX);
Zhigang Li, Tang Gu (CN);
Yanfang Zhang, Binhai Xinqu (CN) --.

Signed and Sealed this
Ninth Day of August, 2016

Michelle K. Lee

Michelle K. Lee
*Director of the United States Patent and Trademark Office*